US007520080B2

(12) United States Patent
Pitcher et al.

(10) Patent No.: US 7,520,080 B2
(45) Date of Patent: Apr. 21, 2009

(54) POLE FOR POSTER SUPPORT ATTACHMENT AND REMOVAL

(75) Inventors: David E Pitcher, Cambridge, MA (US); Thomas P. Burrous, Andover, MA (US)

(73) Assignee: Rose Displays, Ltd., Salem, MA (US)

( * ) Notice: Subject to any disclaimer, the term of this patent is extended or adjusted under 35 U.S.C. 154(b) by 0 days.

(21) Appl. No.: 10/616,439

(22) Filed: Jul. 9, 2003

(65) Prior Publication Data

US 2005/0005560 A1 Jan. 13, 2005

(51) Int. Cl.
*G09F 3/20* (2006.01)

(52) U.S. Cl. ..... 40/658; 40/661.01; 40/617; 248/326.3; 281/45; 24/462

(58) Field of Classification Search ..... 52/489.1, 52/526, 522, 525, 489.2, DIG. 1; 248/225.11, 248/222.41, 316.3; 40/658, 661.01, 617; 281/45; 24/462

See application file for complete search history.

(56) References Cited

U.S. PATENT DOCUMENTS 2,969,754 A * 1/1961 Wilson ..... 52/474
3,168,954 A * 2/1965 Von Herrmann ..... 211/50
3,488,828 A * 1/1970 Gallagher ..... 29/451
3,604,071 A * 9/1971 Reimels ..... 24/543
4,825,931 A * 5/1989 Fein ..... 160/327
4,835,824 A * 6/1989 Durham et al. ..... 24/339
5,022,126 A * 6/1991 Davis ..... 24/543
5,179,768 A * 1/1993 Jio ..... 24/545
5,371,992 A * 12/1994 O'Berry ..... 52/741.1
5,711,430 A * 1/1998 Andersen et al. ..... 211/45
6,266,854 B1 * 7/2001 Ancona et al. ..... 24/499

* cited by examiner

*Primary Examiner*—Richard E Chilcot, Jr.
*Assistant Examiner*—Chi Q Nguyen
(74) *Attorney, Agent, or Firm*—Don Halgren

(57) ABSTRACT

An elongated poster support arrangement comprising an elongated extrusion having an uppermost wall and a tapered sidewall which extends angularly from the uppermost wall. A central support wall is arranged between the tapered sidewall to define an elongated longitudinally disposed chamber between the tapered sidewall and the central support wall. The longitudinal chamber has a slot which is arranged to receive a lift tool to permit the poster support to be lifted to and removed from a ceiling rail. The tapered sidewall has a distal edge flange arranged to facilitate sliding engagement of a blade of the lift tool. The blade of the lift tool has a tapered lock member thereon for wedging between the flange and the support wall.

5 Claims, 7 Drawing Sheets

POLE FOR POSTER SUPPORT ATTACHMENT AND REMOVAL

BACKGROUND OF THE INVENTION

1. Field of the Invention

The present invention relates to devices for lifting poster supports to and from an overhead surface, and more particularly to pole assembly arrangements for lifting and removing an elongated poster gripping extrusion onto to a ceiling rail or dis-attaching that poster gripping extrusion from a ceiling rail in a simple manner, and incorporates by reference co-pending U.S. patent applications Rose-16, Elongated Poster Support Arrangement, and Rose-17, Flexible Roller Arrangement, filed concurrently herewith.

2. Prior Art

In the merchandising field particularly as it relates to customers in department stores and shopping malls and the like, poster advertisements are critical. They are changed frequently and often moved around in order to advertise goods and to catch the customer's attention. Setup and the support assembly of these posters has to be very simple to permit the attachment and removal of posters and advertisements from a ceiling rail by relatively low paid employees of that merchandiser or store.

Heretofore, such support arrangements have required rather complicated poles and grasping mechanisms which require a stepladder or careful alignment and careful manipulation of a tool by which the poster is attached to a ceiling rail or removed from a ceiling rail.

It is an object of the present invention to overcome the disadvantages of the prior art.

It is still yet a further object of the present invention to provide a poster support arrangement which will permit the simple installation and removal of the poster support arrangement from a overhead ceiling rail.

It is still yet another object of the present invention to provide a poster support arrangement handling apparatus which will permit the poster to be removed therefrom and a new poster inserted without damaging the poster or the support arrangement in a manner not shown or suggested by the prior art.

BRIEF SUMMARY OF THE INVENTION

The present invention comprises a means for the facile attachment and removal of an elongated poster support arrangement relative to a ceiling rail overhead. A ceiling rail is typically an inverted steel "T" shaped member which normally supports the ceiling tiles in a commercial merchandising establishment. The poster support arrangement of the present invention comprise an elongated extrusion. The elongated extrusion comprising the poster support arrangement has a generally elongated, flat, uppermost side with an elongated magnetic strip adhered thereto The elongated poster support extrusion has a sidewall extending from one edge of the uppermost side. This sidewall has a lowermost or distal edge extending inwardly thereon.

An elongated generally centrally arranged support wall is disposed adjacent to the sidewall in a manner generally perpendicular to the uppermost side. The central support wall may have a connecting web unitary with the first sidewall. The connecting web holds the central support wall in generally rigid alignment with the first tapered sidewall and the upper most side.

The central support wall has a distal or lowermost edge which extends beyond the distalmost edge of the distalmost edge of the first tapered sidewall. A relatively narrow gap or open band is longitudinally disposed between the central support wall and the distalmost edge or flange of the first tapered sidewall. The central support wall, and additional walls or chambers arranged adjacent to the central support wall, opposite the first sidewall, may be arranged so as to permit any number of poster (or other graphic material) gripping means.

The volume between the central support wall and the first tapered sidewall and connecting web defines an elongated "lift-tool" receiving chamber. The elongated lift-tool receiving chamber is arranged to receive a poster support arrangement lift tool to permit the raising and lowering of the poster and the poster support arrangement relative to an elevated ceiling rail in a store.

The gripping means may vary depending on the needs of the particular application. A variety of differently shaped chambers may be arranged to allow posters to be supported by such means as hooks, clips, wedge-and-roller arrangements, as well as other means.

A poster support arrangement lift tool may be utilized to lift the poster support arrangement onto the ceiling rail and secured thereto preferably by a magnetic means therebetween. The poster support arrangement lift tool comprises a planar, blade-like apparatus arranged on the distalmost end of an elongated pole. The pole may be telescopable or long enough to reach a ceiling rail. The planar blade apparatus is arranged on the distal end of the pole disposed thereon perpendicular to the pole. The blade may have a linear or straight edge having a scive thereon. The width of the blade is preferably about 2 to 3 inches. The blade is of a thickness which is slightly less than the width of the gap between the central support wall and the first sidewall. The planar blade is inserted into the gap between the central support wall and the first sidewall in the elongated tool receiving chamber therebetween, in order to engage the pole with the support mechanism for purposes of raising or lowering a poster.

A locking member may be arranged as a generally wedge-shaped protrusion on a first side of the blade of the tool, so as to provide a securement means between the blade and the poster support arrangement. The lock member mates within the flange at the lowermost side of the first tapered sidewall and provides a press-fit between the blade and the lift tool receiving chamber. The lock member extends only as close to the edge of the blade as the depth of the lift tool receiving chamber. A simple tilting of the blade along the plane of the poster, with respect to the poster support arrangement will permit the separation of blade of the tool from the elongated tool receiving chamber. Thus the pole and blade arrangement is easily engaged and disengaged with and from the poster support apparatus'elongated tool receiving chamber.

The invention thus may comprise an elongated poster support arrangement comprising: an elongated extrusion having an uppermost wall, a sidewall, the sidewall extending from the uppermost wall; a central support wall arranged adjacent to the sidewall to define an elongated longitudinal chamber between the sidewall and the central support wall, wherein the longitudinal chamber has a slot which is arranged to receive a lift tool to permit the poster support to be lifted to and removed from a ceiling rail. The sidewall may have a distal edge flange to lockingly engage the blade of the lift tool. The blade of the lift tool has a tapered lock member thereon for wedging between the flange and the support wall. The tapered lock member is preferably of generally triangular shape not extending the full width of the blade. The tapered lock member preferably has a first tapered side and a second tapered side to permit rocking disengagement of the blade from the elongated extrusion.

The invention also may comprise a poster attachment tool for lifting and removing an elongated extrusion from a ceiling rail, comprising: an elongated pole; a generally planar blade attached to the pole, the blade having a distal edge thereon, the distal edge have a scive thereon; and the blade also preferably having a tapered lock member on a face portion thereof to permit wedging engagement and wedging disengagement of the blade with the elongated extrusion. The tapered lock member preferably has a first tapered side and a second tapered side to permit disengagement of the tool from the extrusion.

The invention may also include a method of engaging an elongated extrusion relative to a ceiling rail, the elongated extrusion having an elongated receiving channel therein, the receiving channel defined by a support wall and an adjacent wall, the method comprising the steps of: inserting a generally planar blade disposed on a distal end of an elongated pole into the receiving channel in the extrusion; biasing away the first wall from the support wall by a tapered lock member on a face portion of the blade to first permit engagement of the extrusion by the tool and secondly, to permit subsequent disengagement from the extrusion by the tool. The method may include: pivoting the pole in a plane parallel to the extrusion to permit the blade to be removed from the extrusion; pivoting the pole in a plane perpendicular to the extrusion to permit the extrusion to be separated from the ceiling rail by breaking the magnetic attraction between the magnetized upper portion of the extrusion and the ceiling rail; wedging the tapered lock member into and out of engagement with respect to the elongated extrusion by sliding the tapered lock member against the support wall and the first wall; arranging a scive on a distal edge of the blade to facilitate entry of the blade into engagement with the elongated extrusion; and arranging a triangular locking mechanism which ends before the end of the blade so that a simple rocking motion may disengage the pole from the extrusion without disengaging the magnetic strip gripping the ceiling rail.

The invention may also include the method including the steps of arranging a scived apex on the locking member to facilitate movement of the blade into and out of engagement with the elongated extrusion, wherein the sidewall may have a flange on its distalmost edge to engagingly retain the blade in the receiving chamber; and wherein the extrusion also has an elongated chamber therein for receipt of a poster; and wherein the outermost comer of the blade functions as a lever point to facilitate removal of the blade from the extrusion; wherein the blade is a lever to bias the extrusion from attachment to the ceiling rail; and wherein the blade is arranged on a distal end of an elongated pole.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1:
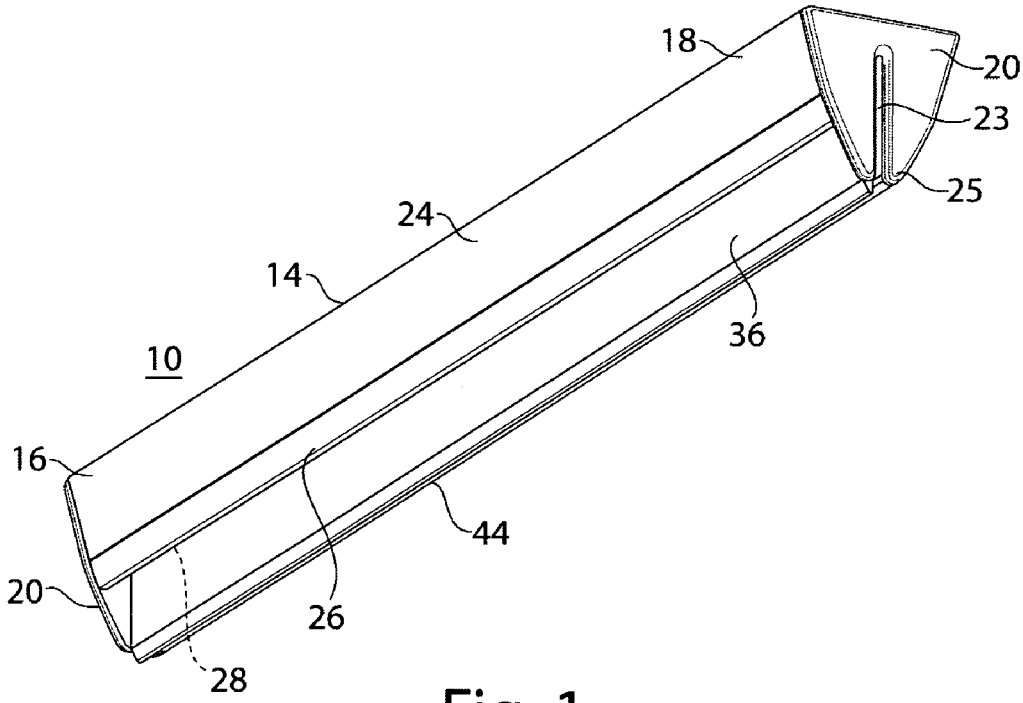
FIG. 1 is a perspective view of a poster support arrangement constructed according to the principles of the present invention.
Figure 3:
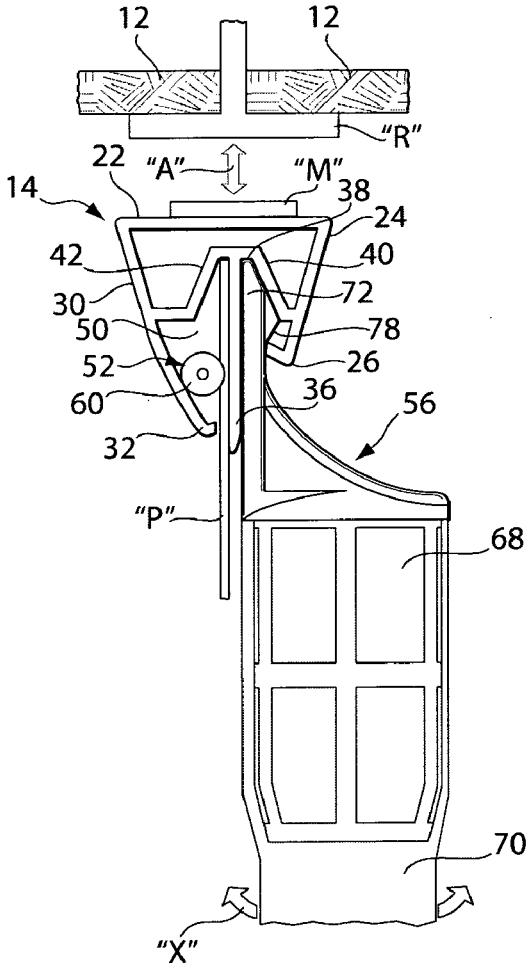
FIG. 3 is an end view of the extrusion of the present invention with the gripping means, a poster and the poster support arrangement lift tool therewith shown approaching a ceiling rail.

Referring now to the drawings in detail, and particularly to FIG. 1, there is shown a first preferred embodiment of the present invention which comprises a poster support arrangement 10 for the receipt of a flat flexible poster "P" therewithin and for the facile attachment of that elongated poster support arrangement 10 to a ceiling rail "R" overhead, as represented in FIG. 3. A ceiling rail "R" is typically an inverted "T" shaped member which normally supports the ceiling tiles 12 in a commercial merchandising establishment.

The poster support arrangement 10 of the present invention comprises an elongated extrusion 14, as shown in FIG. 1. The elongated extrusion 14 comprising the poster support arrangement 10 has a generally elongated, flat, uppermost side 22. The elongated poster support extrusion 14 has a first sidewall 24 extending from one edge of the uppermost side 22, as may be seen in FIGS. 2 and 3. The first sidewall 24 has a lowermost or distal edge 26 with a lip or flange 28 extending inwardly thereon.

An elongated central support wall 36 is disposed adjacent to the first sidewall 24 in a manner generally perpendicular to the uppermost side 22. The central support wall 36 has a first or uppermost edge 38 with a connecting support web 40 unitarily extruded therewith, and is connected to an inside portion of the first tapered sidewall 24. The first and second connecting webs 40 and 42 hold the central support wall 36 in generally rigid alignment with the first sidewall 24 as well as the wall comprising the uppermost side 22.

Figure 2:
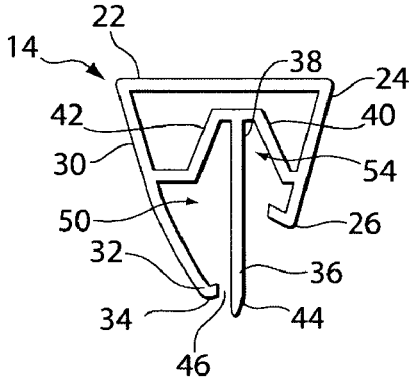
FIG. 2 is an end view of the elongated extrusion of the present invention.

The central support wall 36 has a distal or lowermost edge 44 which extends beyond the distalmost edge 32 of the distalmost edge 26 of the first sidewall 24, as best shown in FIG. 2. A relatively narrow gap or open band 46 is longitudinally disposed between the central support wall 36 and the distalmost edge 26 and flange 28 of the first sidewall 24. A second sidewall 30 extends opposite to the central wall 36 from said first sidewall 24, with an elongated gap 46 therebetween, as best shown in FIG. 2.

A gripping means enclosure chamber 50 is elongated and is arranged to receive a gripping means 52 disposed longitudinally therewithin. The volume between the central support wall 36 and the first tapered sidewall 24 and its respective connecting web 40 defines an elongated "lift-tool" receiving chamber 54, as is represented in FIG. 2. The elongated lift-tool receiving chamber 54 is arranged to receive a poster support arrangement lift tool 56, as shown in FIGS. 3, 4, 5, 6, 7, 11, 12, 13 and 14 to permit the raising and lowering of the poster "P" and the poster support arrangement 10 relative to an elevated ceiling rail "R" in a store, as is represented by the arrow "A" in FIG. 3.

The poster support arrangement lift tool 56 may be utilized to lift the poster support arrangement onto the ceiling rail "R"

and secured thereto by a magnetic means "M" therebetween or the like, as represented in FIG. 3. The poster support arrangement lift tool 56 comprises a planar blade 72 arranged on the distalmost end of an elongated pole 70. The pole 70 may be telescopable or long enough to reach a ceiling rail. The blade 72 may have a linear or straight edge 74 thereon, as best seen in FIGS. 4, 5, 6 and 7. It is intended that the blade 72 have a width of about 2 to 3 inches. The planar blade 72 is inserted into the gap 48 between the central support wall 36 and the first tapered wall 24 in the elongated tool receiving chamber 54 therebetween, as represented in FIG. 3.

A tapered lock member 78 may be arranged as wedge on a first side of the blade 72 of the lifting tool 56, as shown in FIG. 3 and shown more clearly in FIGS. 4, 5, 6 and 7, so as to provide a wedged securement means between the blade 72 and the poster support arrangement 10 during movement thereof. This is shown more clearly in FIGS. 11, 12, 13 and 14, and will be discussed more fully hereinbelow.

Figure 4:
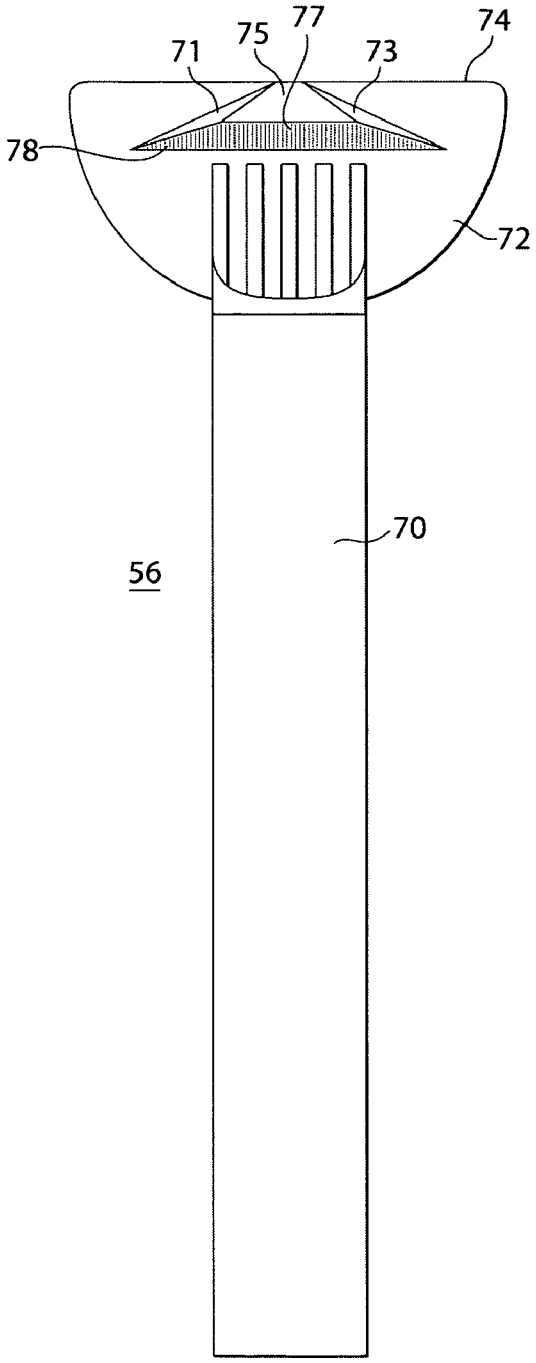
FIG. 4 is a side elevational view of the lifting tool apparatus.
Figure 5:
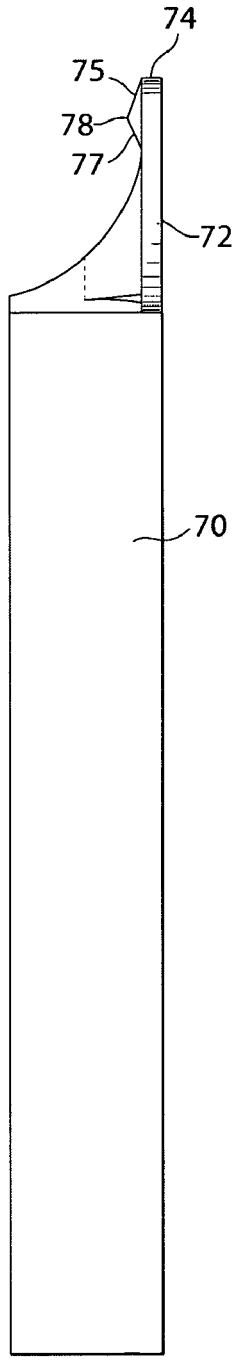
FIG. 5 is an end elevational view of the lifting tool apparatus shown in FIG. 4.
Figure 6:
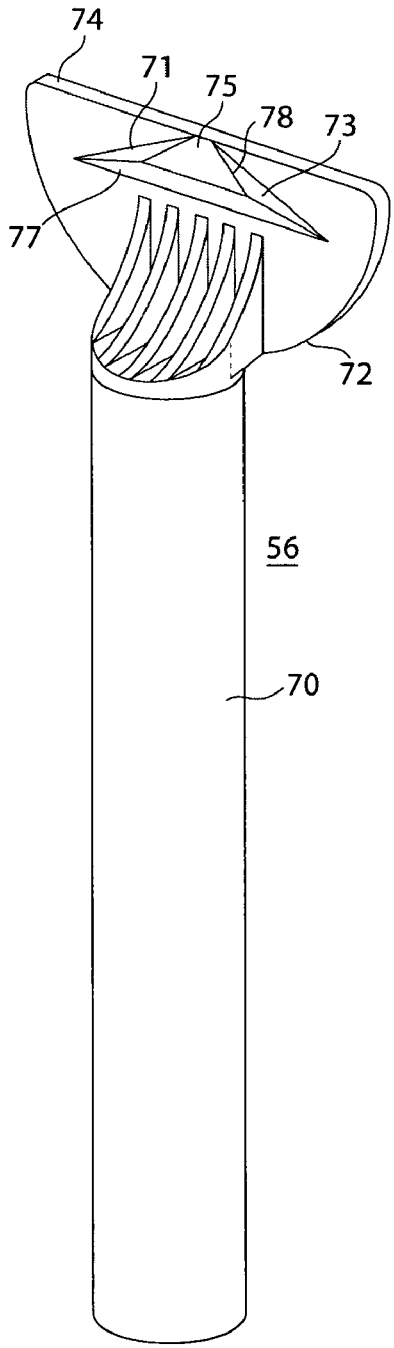
FIG. 6 is a perspective view of the wedge side of the blade of the lifting tool apparatus.
Figure 7:
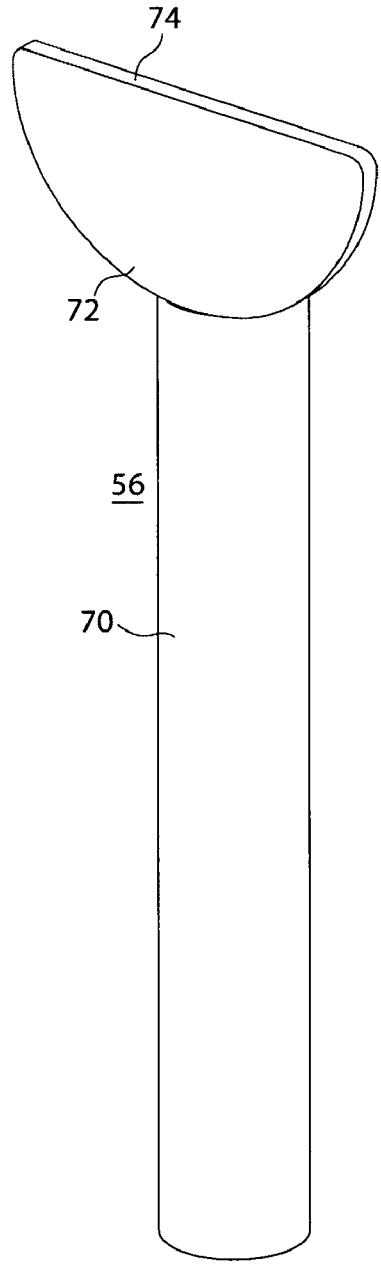
FIG. 7 is a perspective view of the back side of the blade of the lifting tool apparatus.

The tapered lock member 78 is of generally triangular shape, as best shown in FIGS. 4 and 6, having a first tapered side 71 and a second tapered side 73 and a generally triangularly shaped, tapered face portion 77. A scived truncated apex 75 of the lock member 78 is arranged on the front side of the blade 72, as may be seen in FIGS. 4, 5 and 6.

Figure 8:
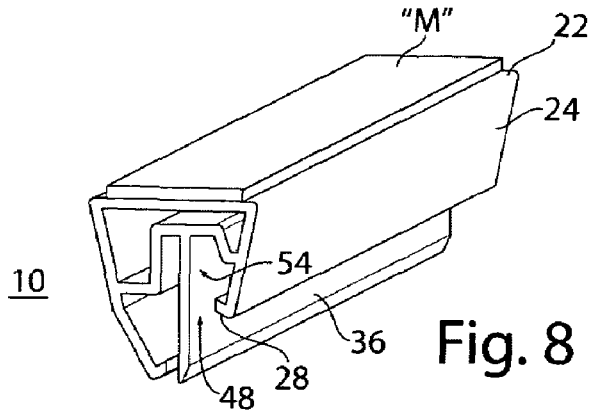
FIG. 8 is a perspective view of a further embodiment of a poster support extrusion which is moved by the lifting tool apparatus.

The tapered lock member 78 is wedgedly pushed through the gap 48 into the space between the flange 28 on the side wall 24 and the support wall 36, as for example, is represented in the particular embodiment of the extrusion comprising the poster support arrangement 10 in FIG. 3. The lock member 78 mates between the flange 28 and the wall 36 at the lowermost side of the first tapered sidewall 24. A corresponding extrusion is shown as the poster support arrangement 10 and is shown in a perspective view in FIG. 8.

Figure 9:
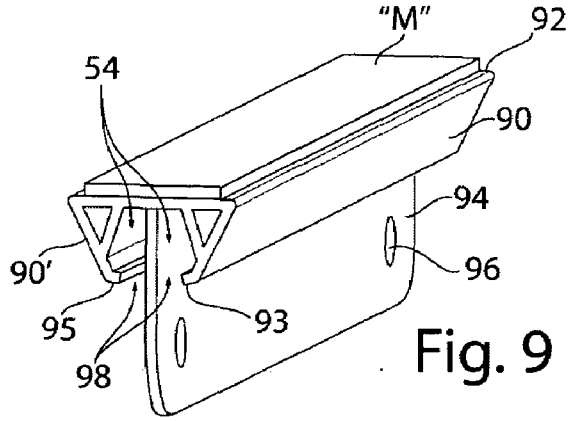
FIG. 9 is a perspective view of yet a further embodiment of a poster support extrusion which is moved by the lifting tool apparatus.
Figure 10:
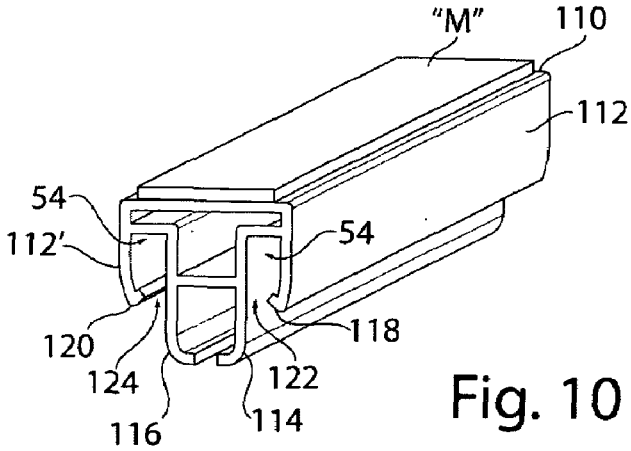
FIG. 10 is a perspective view of still a further embodiment of a poster support apparatus which is moved by the lifting tool apparatus.

A further example of the extrusion comprising the poster support arrangement 10 is shown in FIG. 9 where a first and a second side wall 90 and 90' extends from an edge of an elongated upper surface 92 having a magnetic strip "M" thereon. A support wall 94 extends generally perpendicularly from that upper surface 92 and adjacently to the side walls 90 and 90', as shown in FIG. 9. The side walls 90 and 90' have an elongated flange 93 and 95 respectively, directed towards the support wall 94. The support wall 94 has poster attachment means 96, such as attachment openings by which a poster, not shown for clarity, may be attached thereto. An elongated gap 98 is disposed respectively between the side walls 90 and 90' and the support wall 94. The elongated gap 98 is arranged to receive the planar blade 72, for manipulation of the poster support arrangement 10, as will be described further hereinbelow. A further embodiment of such an extrusion comprising the poster support arrangement 10 is shown in FIG. 10, wherein an upper elongated surface 110 has a pair of elongated first and second side walls 112 and 112' extending from the side edges thereof. The upper surface 112 preferably has a magnetic strip "M" thereon. A pair of support walls 114 and 116 are arranged adjacent one another, between the side walls 112 and 112', as shown in FIG. 10. The side walls 112 and 112' have an elongated, inwardly directed flange 118 and 120 respectively. An elongated gap 122 and 124 is disposed between the side walls 112 and 112' and their respective adjacent support walls 114 and 116. Such elongated gaps 122 and 124 are arranged to receive (preferably either one at a time) the blade 72 of a lift tool 56, to enable a poster support arrangement 10 to be adhered to or removed from a ceiling rail "R" as represented in FIGS. 3 and 11, 12, 13 and 14.

Figure 11:
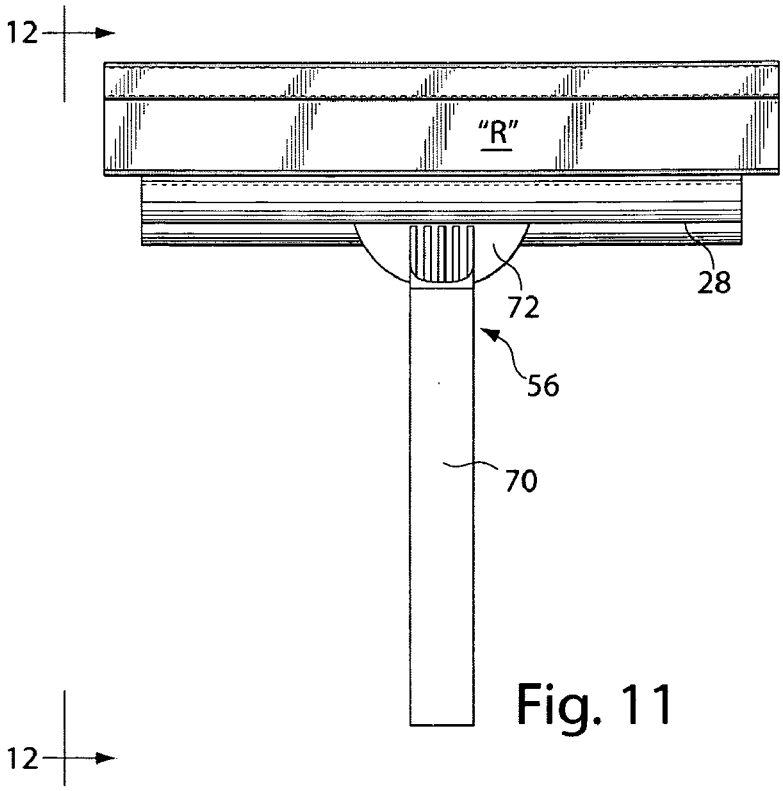
FIG. 11 is an elevational view of the poster support extrusion shown in FIG. 10 attached to a ceiling rail, with a lifting tool apparatus inserted therein.
Figure 13:
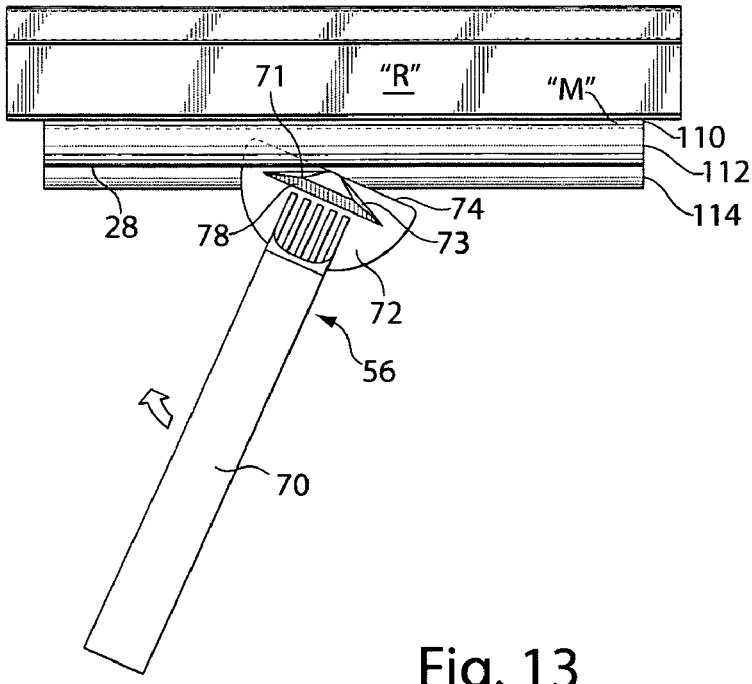
FIG. 13 is a view similar to FIG. 11 showing the lifting tool apparatus being separated from the poster support extrusion.
Figure 12:
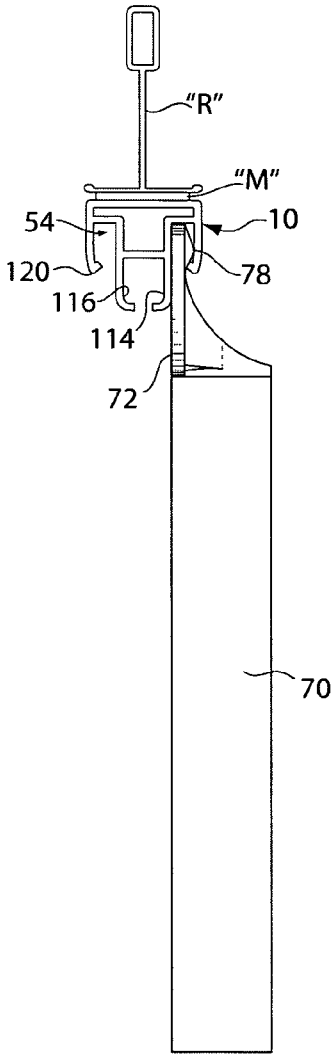
FIG. 12 is a view taken along the lines 12-12 of FIG. 11.
Figure 14:
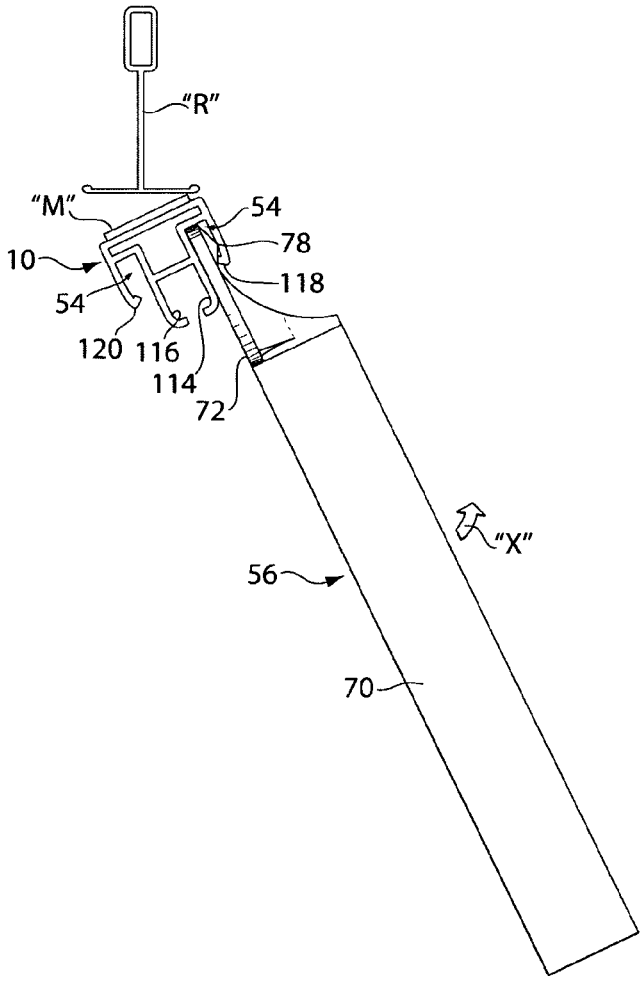
FIG. 14 is a side elevational view of the poster support extrusion being removed from a ceiling rail by a pivoting of the lifting tool apparatus.

In use of such a lifting tool 56, the edge 74 of the blade 72 is inserted into the chamber 54 and the triangular member 78 as well, as represented in FIGS. 3, 12 and 14. A simple side to side (in "planar alignment" with the wall 36) pivoting of the pole 70 with respect to the poster support arrangement 10 will effect a pushing of the flange 28 on the side wall 24 away from the support wall 36. As the blade 72 is pivoted to one side (parallel to the plane of the blade 72), either the first tapered side 71 or the second tapered side 73 slips beyond the distal edge of the flange 26 to disengage the blade 72 from its pinched grip between the wall 36 and the distal edge of the flange 28, as represented in FIGS. 11 and 13. This action permits the separation of blade 72 of the lift tool 56 from the elongated tool receiving chamber 54 of the support arrangement 10. The pivoting of the pole 70 and hence the blade 72 in a direction perpendicular to the longitudinal axis of the poster support 10, as indicated by the arrows "X" represented in FIGS. 3 and 14, pivots by lever action both the poster support 10 and the magnetic strip "M" from magnetic attachment to its ceiling rail "R", wherein the entire poster support 10 and any poster therewith,may be removed from its ceiling position and lowered for simple exchange of a poster therein.

Thus what has been shown is a unique arrangement for attaching and removing an extruded poster support relative to a ceiling rail in a most simple and easily usable manner.

The invention claimed is:

1. An elongated poster support and lift tool arrangement for providing hanging support to a poster from a ceiling rail, comprising:

an elongated extrusion having an uppermost wall, a first sidewall, said first sidewall extending from said uppermost wall;

an elongated lift tool;

a central support wall arranged adjacent said first sidewall to define a longitudinal empty chamber between said first sidewall and said central support wall, wherein said longitudinal empty chamber has an open, unobstructed lift-tool-receiving slot on a lower side thereof, said slot arranged to wedgingly receive a lift tool to permit said poster support to be controllably lifted to and removed from a ceiling rail without interfering with a poster carried by said elongated poster support; wherein a second sidewall is arranged opposed to said central support wall with respect to said first sidewall, said second sidewall and said support wall have an elongated gap therebetween, for sliding receipt of a poster therein; and wherein an arrangement of connecting webs is arranged between said sidewalls and said central wall, to hold said central support wall rigid.

2. The elongated poster support and lift tool arrangement as recited in claim 1, wherein said first sidewall has a distal edge flange to slidingly engage a blade of said lift tool.

3. The elongated poster support and lift tool arrangement as recited in claim 2, wherein said blade of said lift tool has a tapered lock member thereon for wedging between said flange and said central support wall.

4. The elongated poster support and lift tool arrangement as recited in claim 3, wherein said tapered lock member is of generally triangular shape.

5. The elongated poster support and lift tool arrangement as recited in claim 3, wherein said tapered lock member has a first tapered side and a second tapered side to permit rocking disengagement of said blade from said elongated extrusion.

* * * * *